United States Patent [19]

Poulin

[11] Patent Number: 4,586,770

[45] Date of Patent: May 6, 1986

[54] ELECTRICAL RECEPTACLE

[76] Inventor: Fernand H. Poulin, 423 McDonald, Granby, Canada

[21] Appl. No.: 611,014

[22] Filed: May 14, 1984

[30] Foreign Application Priority Data

Oct. 28, 1983 [CA] Canada ..... 439961

[51] Int. Cl.[4] ..... H01R 13/635

[52] U.S. Cl. ..... 339/74 R; 339/75 P; 339/113 L

[58] Field of Search ..... 339/74 R, 75 M, 75 P, 339/113 L, 154 A, 156 R, 159 R, 159 C, 164 R

[56] References Cited

U.S. PATENT DOCUMENTS

| | | | |
|---|---|---|---|
| 1,404,098 | 1/1922 | Dennis | 339/74 R |
| 1,720,463 | 7/1929 | Both | 339/113 L |
| 1,941,374 | 12/1933 | Weisburg | 339/74 R |
| 2,002,558 | 5/1935 | Von Holtz | 339/74 R |
| 2,266,130 | 12/1941 | Theriault | 339/74 R |
| 2,636,096 | 4/1953 | DiBlasi | 339/159 |
| 3,063,006 | 11/1962 | Steinberger | 324/51 |
| 3,710,304 | 1/1973 | Warner et al. | 339/74 R |
| 3,890,030 | 6/1975 | McDaniel | 324/51 |
| 3,919,471 | 11/1975 | Spiessbach et al. | 178/7.1 |
| 4,111,516 | 9/1978 | Wireman | 339/113 R |
| 4,118,690 | 10/1978 | Paynton | 339/113 R |
| 4,205,376 | 5/1980 | Yoshida | 364/424 |
| 4,298,190 | 11/1981 | MacKay | 266/156 |
| 4,484,185 | 11/1984 | Graves | 339/75 P |

FOREIGN PATENT DOCUMENTS

| | | | |
|---|---|---|---|
| 404754 | 5/1942 | Canada . | |
| 846386 | 7/1970 | Canada . | |
| 882349 | 9/1971 | Canada . | |
| 932057 | 8/1973 | Canada . | |
| 780162 | 4/1935 | France | 339/74 R |

OTHER PUBLICATIONS

R. T. Evans, "Wedge-Activated Low Insertion Force Connector", IBM Technical Disclosure Bulletin, vol. 11, #11, Apr. 1969, p. 1443.

*Primary Examiner*—John McQuade

*Attorney, Agent, or Firm*—Salter & Michaelson

[57] ABSTRACT

The invention describes an electrical receptacle comprising a housing having apertures for receiving blade-type contacts of a plug in which the plug is formed with an aperture at its free end, and a pair of contacts secured in the interior of the housing in longitudinal alignment with the apertures for electrically conductively contacting plug contacts inserted through the apertures, each contact member having a flexible contact portion having a projection releasably interlockable with the aperture of a plug contact to prevent inadvertent withdrawal of the plug contacts from the housing and an arrangement for selectively manually displacing the contact portions for releasing the plug contacts.

2 Claims, 8 Drawing Figures

ELECTRICAL RECEPTACLE

The present invention relates to an electrical receptacle and, more specifically, to a receptacle which is adapted to be releasably secured or interlocked with a mating electrical plug.

BACKGROUND OF THE INVENTION

As is well known, conventional electrical plugs are held in electrical contact with conventional electrical receptacles by frictional contact between the contact members of the plug and receptacle. This arrangement is quite acceptable for most applications in which the appliance is not moved during use. Such applications include for example lamps, radios, and other such appliances. However, there are applications, such as in the use of power tools and the like, in which electrical appliances are moved during use and as often happens excessive tension applied to the electrical cord of the appliance disconnects the plug from the receptacle. Not only is this inconvenient, it can create a hazardous condition. There are other situations in which it is essential that the plug not become inadvertently disconnected from the receptacle. The frictional contact forces generated by conventional plugs and receptacles is insufficient to provide the security required in the latter situations.

There are also situations in which it is desirable to have a visible indication of electrical continuity in a conductor and, particularly, through a plug-receptacle connection.

SUMMARY OF THE INVENTION

The present invention seeks to provide an electrical receptacle which is releasably and positively secured to the plug with which it is used so as to preclude inadvertent disconnection of the plug and receptacle. The present invention also seeks to provide a receptacle which provides a visual indication of electrical continuity.

In accordance with the present invention there is provided an electrical receptacle comprising a housing having aperture means therein for receiving at least a pair of blade-type male contact members each having a recess or aperture extending transversely therethrough and at least one pair of transversely flexible blade-type contact members secured to the interior of the housing in longitudinal alignment with the aperture means for electrically conductively contacting male contact members inserted into the housing through the aperture means. Each flexible contact member has interlocking means releasably engageable with the aperture of a male contact member for preventing withdrawal of the male contact member from the housing. The receptacle further includes means extending from the housing for flexibly displacing each of the flexible contact members and disengaging the flexible and male contact members.

BRIEF DESCRIPTION OF THE DRAWINGS

These and other features of the invention will become more apparent from the following description in which reference is made to the appended drawings, wherein.

DESCRIPTION OF A PREFERRED EMBODIMENT

Figure 1:
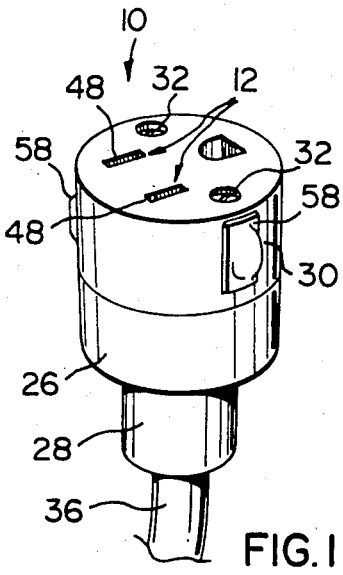
FIGURE 1 is a perspective view of an electrical receptacle in accordance with the present invention.

FIGS. 1 to 4 illustrate one embodiment of the the electrical receptacle of the present invention which is specifically adapted for use with extension cords and the like.

Generally, the electrical receptacle of FIGS. 1 to 4 is comprised of a housing 10 having aperture means 12 therein for receiving a pair of blade-type male contact members 14 (FIG. 3), of a plug 15, each having a recess or aperture 16 extending transversely therethrough. The receptacle includes a pair of transversely flexible blade-type contact members 20 secured to the housing interiorly thereof in longitudinal alignment with aperture means 12 for electrically conductively contacting male contact members 14 inserted into the housing through the aperture means. Each flexible contact member 20 has interlocking means 22 which are releasably engageable with aperture 16 of a male contact member for preventing withdrawal of the male contact member from the housing. The receptacle further includes means 24 extending from the housing for flexibly displacing each of the flexible contact members so as to thereby disengage the flexible and male contact members.

Housing 10 includes a first housing section or base 26 having a neck portion 28 and a second housing portion 30 releasably secured to the base by screws 32 to enable attachment of conductors 34 of an electrical cord 36 to the the flexible contact members as explained below. Sections 26 and 30 together define a chamber 38 in which the flexible contact members are disposed. The chamber includes a support surface 40 to which the contact members are secured by screws 42. Screws 42 also serve to electrically connect conductors 34 to the contact members as shown. A channel 44 extends concentrically through neck 28 from the support surface to end face 46 of the neck for admitting cord 36 into chamber 38.

Figure 2:
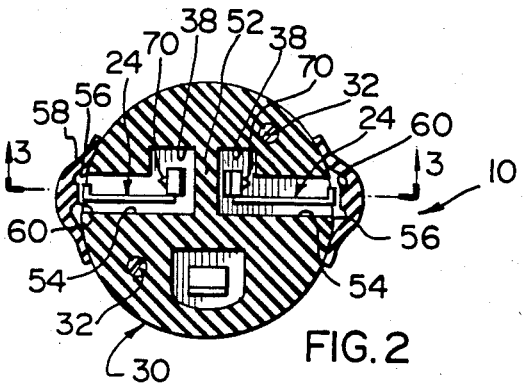
FIGURE 2 is a cross-sectional view taken along line 2—2 of FIG. 3.
Figure 3:
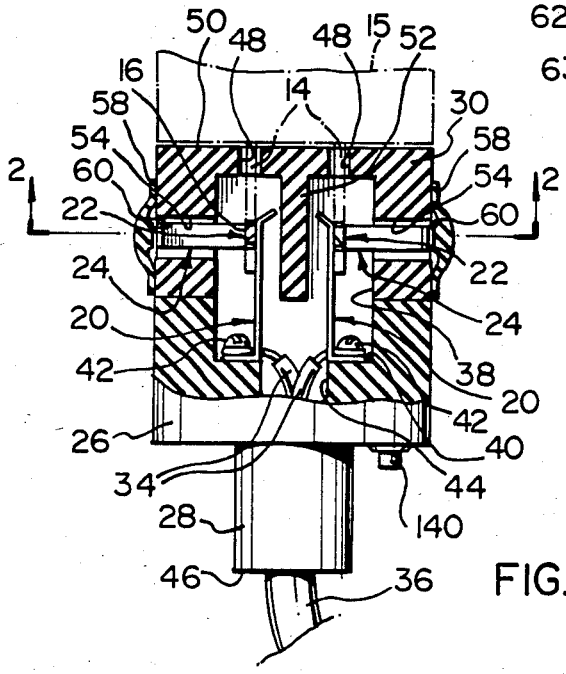
FIG. 3 is a cross-sectional view taken along line 3—3 of FIG. 2.

As best illustrated in FIG. 3, aperture means 12 are transversely spaced slots 48 which extend longitudinally of the section 30 from chamber 38 to end face 50 of section 30. Section 30 includes a transversely extending wall means or partition 52 for electrically separating contact members 20 from one another as shown in FIGS. 2 and 3. A pair of channels 54 extend transversely of section 30 from chamber 38 to the exterior surface of the receptacle at which openings 56 are formed. Channels 54 serve to communicate displacing means 24 to the exterior of the housing. Openings 56 are closed by flexible covers 58, constructed of rubber or like material, secured to the exterior surface of the receptacle. Covers 58 each include a rigid projection 60 for transferring inwardly directed forces to the ends of the displacing means.

Figure 4:
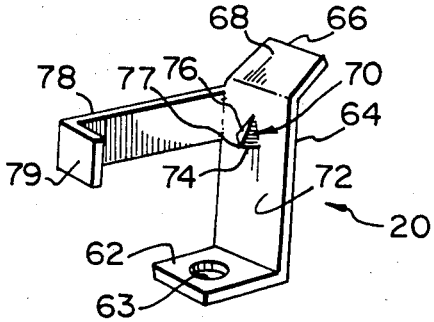
FIG. 4 is a perspective view of a contact member disposed in the receptacle illustrated in FIG. 1.

FIG. 4 is a perspective view of a flexible contact member 20. Member 20 includes a base 62, having a hole 63 for receiving a screw 42, and an elongated flexible contact portion 64 arranged to be longitudinally aligned with a slot 48. Free end 66 of contact portion 64 is inclined so as to form a camming surface 68 engageable with the end of a male contact member during insertion. A projection 70 extends from a side surface 72 of contact portion 64 and includes a generally transversely extending surface 74 and an inclined surface 76. Projection 70 terminates in a point 77 so as to facilitate reception of the projection in the aperture of a male contact member.

It will be seen therefore that when the male contacts of a plug are inserted into slots 48, the ends of the contacts will first engage and transversely displace the free ends of the contact portions of contacts 20. Continued insertion of the contacts 14 will result in reception of projections 70 into apertures 16. Engagement between surfaces 74 and the edges of the recesses will prevent withdrawal of contacts 14 from the receptacle.

Displacing means 24 are of the form of integral arms 78 having bent over end portions 79 extending from contact portions 64 and positioned in channels 54 as previously explained. Thus, when inward pressure is applied to covers 58, projections 60 thereof engage the ends 79 of arms 78 and urge the arms and contact portions inwardly until projections 70 exit the apertures of the male contacts.

FIGS. 5 to 8 illustrate a duplex receptacle 100 constructed in accordance with the present invention. The receptacle includes a base 102 and a cover 104 secured to the base by screws 106. Both members are constructed of nonconductive material such as plastic. Base 102 and cover 104 together define a chamber 108 in which a pair of electrical contacts 110 are disposed. The cover is provided with a pair of aperture means 112 and 114 of substantially the same construction as those of the embodiment of FIGS. 1 to 5 for reception of the bladed prongs or contacts of a plug.

Figure 5:
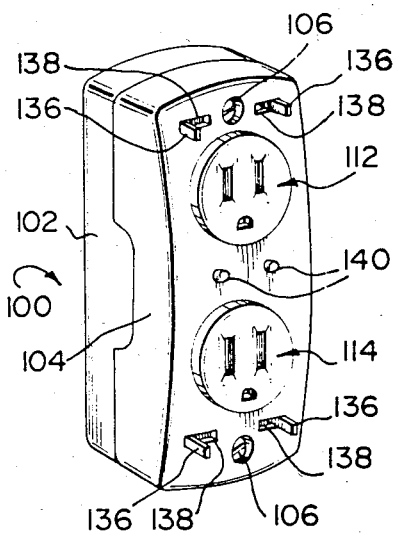
FIG. 5 is a perspective view of a duplex receptacle constructed in accordance with the present invention.
Figure 6:
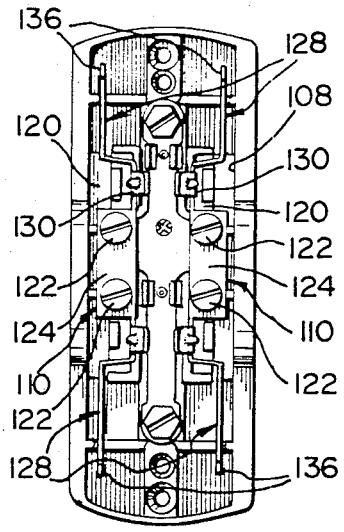
FIG. 6 is a plan view of the base of the duplex receptacle illustrated in FIG. 5.
Figure 8:
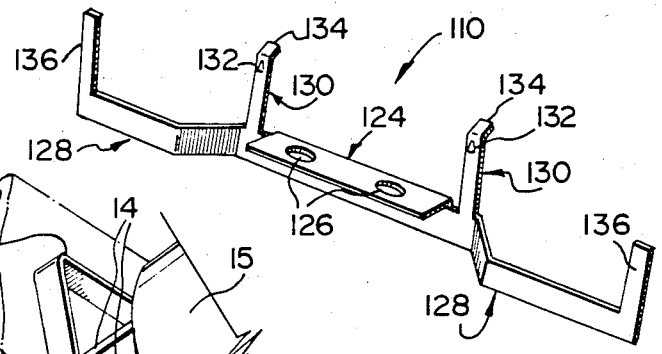
FIG. 8 is a perspective view of a contact member disposed in the receptacle illustrated in FIG. 5.
Figure 7:
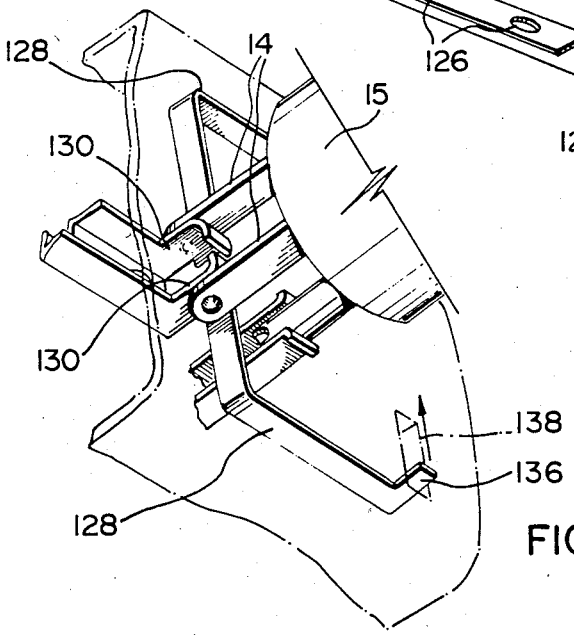
FIG. 7 is a broken perspective view of the engagement between the contact members of the receptacle illustrated in FIGS. 5 and 6 and the contacts of a plug.

Contacts 110 are secured to a support surface 120 of base 102 by screws 122 and each contact services an aperture of each aperture means 112 and 114 as is conventional in duplex receptacles. As best shown in FIG. 8, each contact 110 is an integral component constructed of electrically conductive material and has an L-shaped base 124, having apertures 126 for reception of screws 122, and a pair of arms 28 which are integrally and flexibly connected to and extend longitudinally of each end of the the base. Each arm 128 includes a contact portion 130 which is arranged to be aligned with an aperture of aperture means 112 or 114 and is formed with a projection 132 in the same manner as the contacts of the preceeding embodiment. Similarly, the ends 134 of contact portions 130 are inclined at a suitable angle to the planes of the contact portions to facilitate insertion of the male contact members into the receptacle. The free ends of each arm 128 is formed with a transversely extending finger 136 which is arranged to pass through an associated slot or opening 138 in cover 104 as illustrated in FIG. 5. The natural resilience of the contacts urges fingers 136 to the laterally outer ends of their associated slots.

In operation, it will be seen that upon insertion of the contacts of a plug, the ends of the contacts will engage and laterally inwardly displace the free ends of an adjacent pair of contact portions 130 of contacts 110. Further insertion of the plug contacts will result in reception of projections 132 into the apertures of the plug contacts and interlocking of the plug contacts and contacts 110 as shown in FIG. 8. When it is desired to remove a plug, an adjacent pair of fingers 136 are manually urged laterally inwardly to the opposite ends of their associated slots. This action laterally inwardly displaces contact portions 130 of contacts 110 and disengages projections 132 from the apertures of the plug contacts.

In order to provide an indication of continuity, a light 140, such as a light emmitting diode, is secured to the exterior surface of the receptacle with its leads connected in parallel with the two contacts. Thus, when the receptacle is connected to a source of power, the light will be activated indicating electrical continuity between the receptacle and the source of power.

It will be understood that various modifications and alterations may be made to the above described device without departing from the spirit of the appended claims.

The embodiments of the invention in which an exclusive property or priviledge is claimed are described as follows:

1. A duplex electrical receptacle, comprising:

a housing having a base and a cover releaseably secured to the base, said base and cover together defining an interior chamber, said base having a support surface and means for introducing electrical conductors into said chamber, said cover having a pair of spaced aperture means for admitting blade-type contacts of a plug into said chamber, and a pair of spaced slots in said cover associated with each said aperture means and extending between said chamber and an exterior surface of said housing;

a pair of blade-type electrical contact members disposed in said chamber, each said member having an elongated base adapted to be releasably secured to said support surface and electrically connected to an electrical conductor, an arm extending longitudinally from each end of said base, a flexible contact portion extending from each said arm and being longitudinally aligned with an aperture of one of said aperture means for electrically contacting a plug contact inserted through said aperture, a projection extending from a side surface of each said contact portion for interlockingly engaging an aperture in a plug contact, each said projection having having a locking surface extending substantially transversely of said side of said contact portion and a camming surface extending from said locking surface to said side at an angle thereto and toward a free end of said side, and a finger extending from said arm and outwardly of said chamber through one of said slots, said fingers being arranged to laterally displace said contact portions and release interlocking engagement between said contact portion and a plug contact upon movement of said fingers along said slots.

2. An electrical receptacle as defined in claim 1, further including electrical circuit means in said housing for indicating electrical continuity through conductors connected to said contact members and a source of power.

* * * * *